United States Patent [19]

Sturtz, Jr.

[11] 4,431,365

[45] Feb. 14, 1984

[54] PRESSURE CONTROL MECHANISM FOR A GRAPPLE SKIDDER

[75] Inventor: Charles R. Sturtz, Jr., Romulus, Mich.

[73] Assignee: Clark Equipment Company, Buchanan, Mich.

[21] Appl. No.: 228,857

[22] Filed: Jan. 27, 1981

Related U.S. Application Data

[63] Continuation of Ser. No. 961,344, Nov. 16, 1978, abandoned, which is a continuation of Ser. No. 815,326, Jul. 13, 1977, abandoned.

[51] Int. Cl.[3] ..... B66C 3/16

[52] U.S. Cl. ..... 414/730; 60/420; 91/520; 91/531; 91/518; 294/88

[58] Field of Search ..... 414/729, 730, 731, 732, 414/733, 734, 735, 736, 737, 738, 739, 740, 741, 225, 226, 1, 2, 3, 4, 5, 6, 7; 212/255, 260, 261, 265; 294/88; 91/520, 531, 518

[56] References Cited

U.S. PATENT DOCUMENTS

| | | | |
|---|---|---|---|
| 3,631,989 | 1/1972 | McCormick | 414/744 X |
| 3,811,363 | 5/1974 | Cryder | 91/531 X |
| 3,865,424 | 2/1975 | Jabkowski | 294/88 |
| 3,966,066 | 6/1976 | Schexnayder | 91/531 X |
| 4,201,510 | 5/1980 | Muntjanoff | 294/88 X |

*Primary Examiner*—Frank E. Werner
*Attorney, Agent, or Firm*—John C. Wiessler

[57] ABSTRACT

A pressure control mechanism for the hydraulic control system of a log skidder. Hydraulic circuits for the boom and the grapple of a log skidder are interconnected to provide a pressure control mechanism for the grapple of the skidder. Provided in the interconnecting hydraulic lines for the grapple cylinder and the boom cylinder, between the rod end of the boom cylinder and the base end of the grapple cylinder, is a two-way valve and a check valve. This mechanism provides flow from the boom cylinder to the grapple cylinder. The weight of the load pressurizes the boom cylinder and this pressure is transferred to the grapple cylinder.

3 Claims, 2 Drawing Figures

PRESSURE CONTROL MECHANISM FOR A GRAPPLE SKIDDER

CROSS-REFERENCES TO RELATED APPLICATIONS

This is a continuation of application Ser. No. 961,344, filed Nov. 16, 1978 now abandoned, which was a continuation of application Ser. No. 815,326 filed July 13, 1977 now abandoned.

BACKGROUND OF THE INVENTION

1. Field of the Invention

The invention pertains to logging vehicles of the type generally known as log skidders and particularly to a pressure control mechanism for the grapple mechanism mountable on the log skidder.

2. Description of the Prior Art

There are two general types of log skidders depending upon the boom configuration and its function. The rotary boom skidder has a boom movable through an arc permitting the operator to reach to the right and left of the vehicle to pick up trees that are not in the direct path of the vehicle. Other skidders employ a rigid boom which does not rotate but may be pivoted in a vertical plane to position the grapple over the end of the log. Only the grapple rotates and the machine must be driven to the tree. Either type of machine will usually have a winch driven cable passing over a fairlead on the boom with chokers on the end of the cable for skidding logs which cannot be reached by the grapple.

The grapple, mounted at the distal end of the boom, is lowered in its open position to engage and be closed about a group of logs lying on the ground for hauling by the skidder. The hydraulic cylinder powering the grapple is actuated to close the grapple about the group of logs and then the hydraulic cylinder actuating the boom raises the boom to permit the skidder to drag the logs along the ground to a central location.

It would be desirable to provide a method for maintaining pressure on the grapple cylinder of the grapple skidder since the gripping force of the grapple on the load of logs is directly proportional to the pressure in the grapple cylinder. With low pressure in the cylinder, the grapple will tend to drop logs.

Methods used to maintain constant pressure in the grapple cylinder include the installation of lock valves on the grapple cylinder to maintain pressure. A lock valve cancels out pressure loss due to leakage past a control valve spool, but cannot prevent pressure loss due to the internal cylinder leakage. A lock valve is also ineffective against pressure loss due to crushing of wood fiber or rearrangement of a load into a smaller geometric package.

The prior art also includes the provision of a nitrogen loaded accumulator and a lock valve in the hydraulic circuit controlling the grapple cylinder. Theoretically, this is a good solution, since the lock valve prevents leakage past the control valve spool and the accumulator provides a reservoir of high pressure oil to make up for other system losses. However, in practice, accumulators commonly lose their gas charge and it is impossible to visually determine if the accumulator is functional. Also, accumulators have some shipping restrictions against them due to their high pressure gas charge and they are a potential bomb in a fire.

Experiments with systems utilizing a special valve which detects low grapple pressure and shifts the control valve spool until the circuit is returned to some predetermined pressure have not proved fruitful.

The general failure of these conventional systems have caused most manufacturers to make no special effort to control grapple pressure. The skidder operator is relied upon to periodically actuate the control valve as the load is being skidded. Such a method of controlling grapple pressure is not reliable, depends upon the operator's skill, adds heat to the system and reduces the life of all hydraulic components in the system. Furthermore, the operator cannot steer while actuating the grapple valve.

SUMMARY OF THE INVENTION

In a log skidder having front and rear articulated vehicle sections, including a boom on the rear section and a grapple mounted on the distal end of the boom, a pressure control mechanism for maintaining a pressure in the base end of the double acting hydraulic cylinder powering the grapple when the cylinder is in a loaded condition which is not less than the pressure in the rod end of the boom cylinder.

The hydraulic control system for the skidder comprises a first double acting hydraulic cylinder for the grapple and a second double acting hydraulic cylinder for the boom. There is a source of hydraulic fluid, a hydraulic pump, a hydraulic circuit for the boom and a hydraulic circuit for the grapple. Hydraulic piping interconnects the boom and grapple circuits, connecting the rod end of the boom cylinder with the base end of the grapple cylinder. The pressure control mechanism comprises a check valve and a twoway valve provided in the interconnecting lines to insure that flow is always from the boom cylinder to the grapple cylinder. Such a mechanism provides that the weight of the load pressurizes the boom cylinder and that this pressure is transferred to the grapple cylinder.

In addition, as the machine drives over bumps, high pressure peaks will be generated in the boom cylinder, transferred to the grapple cylinder and stored in the grapple plumbing by virtue of the check valve.

While picking up the load, dropping the load, or driving with no load, the two-way valve is closed and the machine operates exactly the same as the present production skidder.

After the load is picked up in position for skidding, the two-way valve is opened. Pressure in the grapple skidder now cannot be less than that in the boom cylinder. If a log falls from the grapple or if the load shifts to a smaller geometric package size, the boom cylinder will extend and the grapple will tighten up on the load. Further, the operator has a visual indication of grapple pressure by the extent of travel of the boom cylinder.

DETAILED DESCRIPTION OF THE PREFERRED EMBODIMENT

Figure 1:
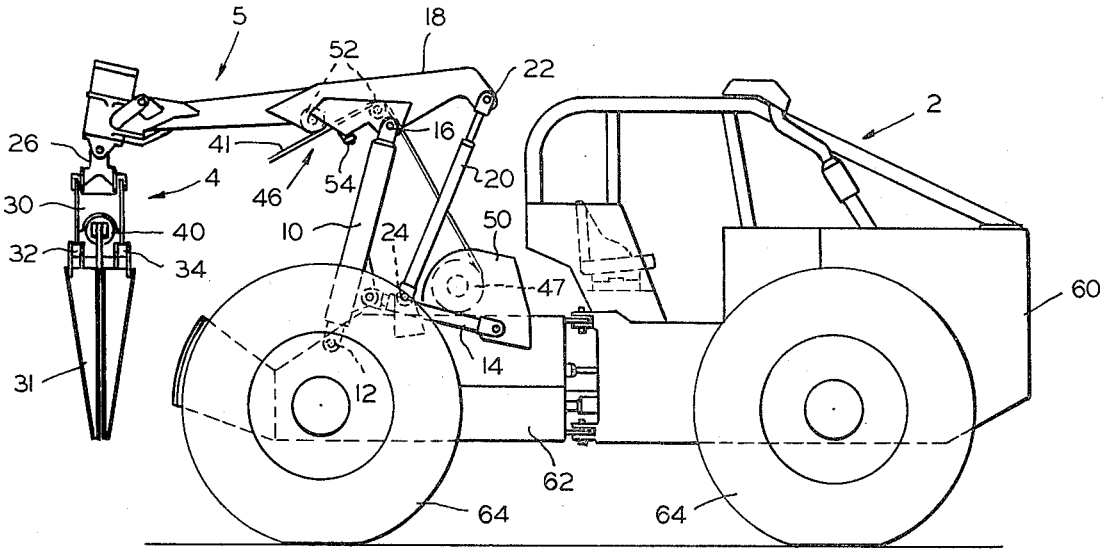
FIG. 1 is a side elevational view of a grapple skidder having a boom pivotally supporting the grapple at the distal end of the boom, the grapple employing the pressure control mechanism embodied in the present invention.

FIG. 1 shows a grapple skidder, a four-wheel drive articulated vehicle 2 having a grapple 4 suspended from a boom 5 which may be pivoted rearwardly in a vertical plane to place the grapple 4 over a load of logs which is then seized and lifted on one end to be dragged or skidded by the vehicle. An arch 10 is pivoted at 12 on opposite sides of the frame of the vehicle 2 adjacent the rear. A pair of double acting piston and cylinder motors 14 are connected, one on each side, at the lower leg portion of the arch 10 and extend forwardly for connection to the vehicle frame. Pivotally connected at 16 to the bight portion of the arch 10 is a grapple support arm 18. The rear end of the arm 18 has a clevis to which a pair of adjustable links 20 are pivotally connected at their upper ends, the links extending down and connected at their lower ends to the frame of the vehicle. At this point it will be seen that a 4-bar linkage has been formed by the arch 10, support arm 18 and adjustable links 20, so that the boom 5 pivots about parallel upper and lower transverse axes through pivots 12, 16, 22, 24. This permits the arm 18 to move along a generally horizontally disposed or flat arc in the vertical center plane of the machine upon actuation of the fluid motors 14. If greater vertical movement of the outer end of the arm 18 is required, then adjustable links 20 can be replaced by a pair of double acting piston and cylinder type fluid motors connected between the pivot points 22–24 although this is not contemplated as necessary in the normal case. Connected at the outer end of the arm 18 by means of a U-joint 26 is the grapple 4. Grapple 4 includes a spreader frame 30 having laterally spaced lower ends to which a pair of grapple tongs 31 are pivotally connected at 32 and 34. A double acting piston and cylinder type motor 40 is pivotally connected at each end thereof between the tongs and serves to open and close them for extension and retraction, thus opening and closing the grapple 4 for gripping the end of a log. Located in the arm 18 is a fairlead 46 for guiding a cable 41 wound upon the drum 47 of winch 50 which, upon occasion may be used instead of grapple 4 to engage a load of logs in a known manner. Fairlead 46 includes a pair of generally horizontally disposed rollers 52 and a pair of vertically inclined rollers 54 which guide the cable as it is pulled by the winch. The end of cable 41 is provided with slip loops or chokers (not shown) which can be placed around the ends of the logs and then winched up behind the skidder. The fairlead assembly is used as a back up system when a log is inaccessible to the grapple.

Fluid motors 14 for pivoting the boom 5 and the motor 40 for operating the grapple 4 are controlled from the cab of the skidder. The vehicle 2 comprises front and rear sections 60,62 supported by wheels 64. Sections 60,62 are articulated and there is normally no problem to drive the skidder into position so that the rear section 62 is in alignment with the log. A self-centering mechanism may be employed to align the grapple mechanism with respect to the log as set forth in U.S. Pat. No. 3,990,688 and assigned to the Assignee of the present invention. Reference may be had to that patent for a more complete description of the self-centering mechanism.

In accordance with the present invention, the double acting boom cylinder 14 is controlled by a hydraulic circuit 65. The hydraulic circuit 65 includes a four-way, three-position, directional control valve 66 with hydraulic connections 67,68 provided respectively between the rod end **14*a* and the base end 14*b* of the boom cylinder 14. A hydraulic pump 70 provides fluid to the hydraulic circuit 65 through the switch 66 as follows. When the valve 66 is moved to the left as viewed in FIG. 2 hydraulic fluid is pumped to the base end 14*b* of the cylinder 14 to lower the boom 5 of the vehicle. To raise the boom of the vehicle 2, the valve 66 is moved to the right of the neutral position shown in FIG. 2 to pump hydraulic fluid to the rod side 14*a* of the boom cylinder 14 to retract the boom cylinder 14 and raise the boom 5. The boom cylinder 14, being a two-way cylinder, discharges fluid from the opposite side when fluid is pumped into a first side through the valve 66. Discharge fluid flows to a reservoir 76**.

The grapple cylinder 40 is controlled by hydraulic circuit 71. A four-way, three-position, directional control valve 72 controls flow of hydraulic fluid from the pump 70 to the grapple cylinder 40 through hydraulic lines 73,74. Line 73 is connected to the base end **40*b* of the grapple cylinder 40 and line 74 is connected to the rod end 40*a* of the grapple cylinder 40. When the valve 72 is positioned to the left of the neutral position shown in FIG. 2, hydraulic fluid is pumped through line 74 to the rod end 40*a* of the grapple cylinder 40 to open grapple tongs 31 to place the grapple 4 in position to receive logs (not shown). With grapple 4 in position to receive logs, the hydraulic valve 72 is moved to the right of the neutral position shown in FIG. 2 to permit hydraulic flow through the line 73 to the base end 40*b* of the grapple cylinder 40 to close the grapple 4 and grapple tongs 31 to grip the load of logs. After the grapple 4 is closed and the boom 5 is raised valves 66 and 72** are returned to the neutral position.

The hydraulic circuits 65 and 71 are interconnected by hydraulic connections 78 and 80. The hydraulic connection 78 extends between hydraulic lines 67 and 73 to connect the rod end **14*a* of the boom cylinder 14 to the base end 40*b* of the grapple cylinder 40. The hydraulic connection 80 connects hydraulic lines 68 and 74 to connect the base end 14*b* of the cylinder 14 to the rod end 40*a* of the grapple cylinder 40. In addition, it may be desirable to provide an anti-cavitation valve (not shown) in the hydraulic system supplying fluid to the cylinders 14 and 40**. The anti-cavitation valve prevents cavitation, i.e., the formation of a partial vacuum in the hydraulic lines, which could possibly draw air through the rod seals of the hydraulic cylinders, thus introducing air into the hydraulic system and reducing the effectiveness of the seals.

The constant pressure mechanism of the present invention comprises a check valve 82 and a two position valve 84 provided in the hydraulic line 78 of the interconnected hydraulic system 65,71.

Figure 2:
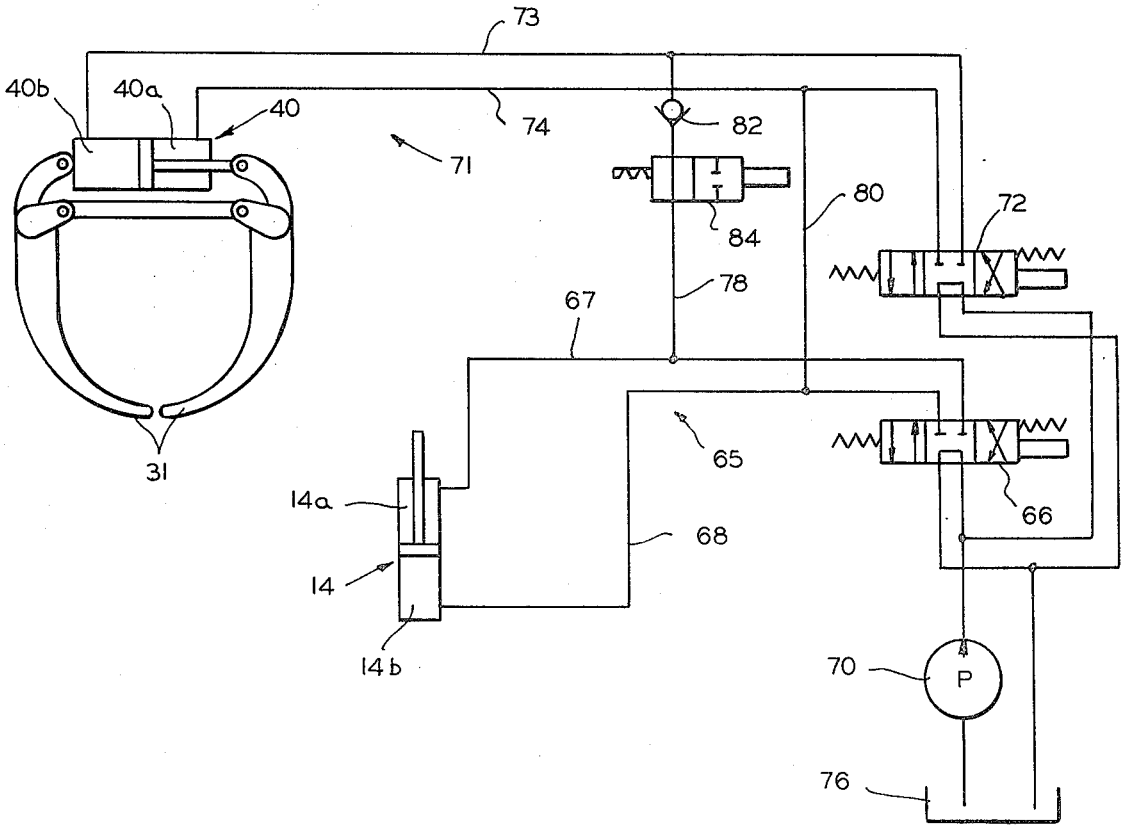
FIG. 2 is a schematic of a hydraulic system which embodies the pressure control mechanism of the present invention.

When the two way valve 84 is closed or to the left of the position shown in FIG. 2, the boom system 65 and the grapple system 71 operate independently. However, when the two-way valve is opened as shown in FIG. 2 and the valves 66 and 72 are in the neutral position shown in FIG. 2, any change in the flow of hydraulic fluid to the rod end **14*a* of the boom cylinder 14 would be reflected in the change in the flow of hydraulic fluid to the base end 40*b* of the grapple cylinder 40. Thus, the boom cylinder 14** acts as an accumulator for the closed system.

Pressure in the grapple cylinder 40 now cannot be less than that in the boom cylinder 14. If a log falls from the grapple 4 or if the load shifts to a smaller geometric package size, the boom cylinder 14 will extend forcing fluid through the line 67 and the check valve 82 to the base end 40*b* of the grapple cylinder 40 to cause the grapple 4 to tighten up the load. High pressure peaks, caused by bumpy terrain and generated by the boom cylinder, could be transferred to the grapple cylinder and retained in the grapple plumbing by the check valve. Thus, the operator will have a visual indication of grapple pressure by the extent of the travel of the boom cylinder.

It should be recognized that any of the hydraulic cylinders mounted on a skidder which generated sufficient pressure could be coupled with the grapple cylinder in the manner described above.

I claim:

1. A hydraulic control system for a self propelled log grapple skidder having a boom arm operated by a first double acting hydraulic cylinder, a grapple operated by a second double acting hydraulic cylinder, and a hydraulic pump for operating both hydraulic cylinders, the system comprising a first three position valve having neutral, extend and retract positions, first conduit means interconnecting said first valve with said first hydraulic cylinder for selectively operating the first hydraulic cylinder independently of said second hydraulic cylinder, a second three position valve having neutral, extend and retract positions, second conduit means interconnecting said second valve with said second hydraulic cylinder for selectively operating the second hydraulic cylinder independently of said first hydraulic cylinder, first interconnecting means between a rod end of said first cylinder and a base end of said second cylinder, operable when said first and second valves are in neutral, for selectively causing said second cylinder to maintain a hydraulic pressure in the base end of the second cylinder not less than the pressure in the rod end of the first cylinder, and second interconnecting means which is open at all times comprising a hydraulic conduit joining the rod end of said second cylinder and the base end of first boom cylinder.

2. A hydraulic control system as in claim 1 in which said first interconnecting means comprises a check valve which permits the flow of hydraulic fluid only from the rod end of said first cylinder to the base end of said second cylinder.

3. A hydraulic control system as in claim 2 in which said first interconnecting means also includes an on-off valve for selectively opening said first interconnecting means.

* * * * *